US006040656A

United States Patent [19]

Kim

[11] Patent Number: 6,040,656

[45] Date of Patent: Mar. 21, 2000

[54] GETTER FLASHING METHOD FOR CATHODE RAY TUBE AND GETTER FOR CONDUCTING SAME

[75] Inventor: Jin-nyun Kim, Kyungki-do, Rep. of Korea

[73] Assignee: Samsung Display Devices Co., Ltd., Suwon, Rep. of Korea

[21] Appl. No.: 09/073,145

[22] Filed: May 4, 1998

[30] Foreign Application Priority Data

Jul. 25, 1997 [KR] Rep. of Korea ..... 97 34928

[51] Int. Cl.[7] ..... H01J 31/00

[52] U.S. Cl. ..... 313/481; 445/31

[58] Field of Search ..... 313/481; 445/31, 445/41, 55

[56] References Cited

U.S. PATENT DOCUMENTS

| | | | |
|---|---|---|---|
| 2,159,946 | 5/1939 | De Boer | 313/481 |
| 2,275,864 | 3/1942 | Record | 445/31 |
| 3,508,105 | 4/1970 | Pappadis | 313/481 |
| 4,145,162 | 3/1979 | Schiabel | 313/481 |
| 4,571,521 | 2/1986 | Gallaro et al. | 313/402 |
| 4,713,578 | 12/1987 | Josephs | 313/481 |
| 5,443,410 | 8/1995 | Ko | 445/73 |

FOREIGN PATENT DOCUMENTS

| | | |
|---|---|---|
| 0110460 | 6/1984 | European Pat. Off. . |
| 2373147 | 6/1978 | France . |
| WO 97/50107 | 12/1997 | WIPO . |

*Primary Examiner*—Kenneth J. Ramsey
*Attorney, Agent, or Firm*—Christie, Parker & Hale, LLP

[57] ABSTRACT

A getter flashing method for a cathode ray tube includes the steps of loading a receptacle of the getter with an active metal, positioning the getter in a funnel such that the active metal is diffused toward an inner surface of the funnel in the vicinity of the getter, and heating and vaporizing the active metal. The getter has a receptacle for receiving the active metal and a support for supporting the receptacle. The receptacle and the support are connected to each other such that an opening portion of the receptacle is directed toward the neighboring funnel portion.

3 Claims, 4 Drawing Sheets

GETTER FLASHING METHOD FOR CATHODE RAY TUBE AND GETTER FOR CONDUCTING SAME

CROSS REFERENCE TO RELATED APPLICATION

This application is based on application No. 97-34928 filed in Korean Industrial Property Office on Jul. 25, 1997, the content of which is incorporated hereinto by reference.

BACKGROUND OF THE INVENTION

1. Field of the Invention

The present invention relates to a getter flashing method for a cathode ray tube (CRT) and a getter for conducting the same, and more particularly, to a getter flashing method using a getter loaded with an active metal such that the active metal is vaporized and diffused toward an inner surface of the funnel in the vicinity of the getter, thereby preventing deterioration in brightness and occurrence of a color bar.

2. Description of the Related Art

Generally, in the CRT manufacturing process, the getter flashing operation is performed after the gas or air exhausting step in order to make the inside of the CRT to be in a high vacuum state.

FIG. 5 is a cross sectional view of a CRT illustrating the conventional getter flashing method. As shown in FIG. 5, the getter 10 has a cup-shaped receptacle 14 for receiving an active metal such as barium and magnesium, and a band-shaped support 12 an upper end of which is connected to the receptacle 14 to support it. A bottom end of the support 12 is fixed on an electron gun 8.

In the conventional getter flashing method, the getter 10 is placed on the inside of the CRT such that the opening portion of the receptacle 14 faces a shadow mask 6. And a high-frequency induction heating coil 18 is installed on the outside of a funnel 2 adjacent to the receptacle 14, and, during the getter flashing operation, applied with a high-frequency induced voltage for a predetermined time. In such a way, the active metal contained in the receptacle 14 is abruptly heated and vaporized. When the vaporized metal condenses, it absorbs residual gases such as hydrogen, carbon dioxide and oxygen to remove them.

However, in the aforementioned conventional method, the vaporized active metal is diffused toward the shadow mask 6 during the getter flashing operation because the opening portion of the receptacle 14 containing the active metal is directed toward the shadow mask 6. As a result, the vaporized metal passing through beam-guide holes of the shadow mask 6 is deposited on a phosphor layer 5 coated on a panel 4, causing discoloration and deterioration in brightness.

Particularly in the mini CRTs such as a 10 inch or 6 inch CRT, a rainbow-shaped color bar appears on the screen because the vaporized active metal is largely deposited on the shadow mask due to the short distance between the getter and shadow mask.

SUMMARY OF THE INVENTION

Accordingly, an embodiment of the present invention is directed to a getter flashing method for a CRT and a getter for conducting the same which substantially obviates one or more of the problems due to the limitations and disadvantages of the related art.

An object of an embodiment of the present invention is to provide a getter flashing method using a getter loaded with an active metal such that the active metal is vaporized and diffused toward an inner surface of a funnel in the vicinity of the getter.

Additional features and advantages of the invention will be set forth in the description which follows, and in part will be apparent from the description, or may be learned by practice of the invention. The objects and other advantages of the invention will be realized and attained by the structure particularly pointed out in the written description and claims hereof as well as the appended drawings.

To accomplish these and other advantages, the getter flashing method includes the steps of loading a receptacle of the getter with an active metal, positioning the getter in a funnel such that the active metal is diffused toward an inner surface of the funnel in the vicinity of the getter, and heating and vaporizing the active metal.

The getter for the CRT includes a receptacle for receiving an active metal, a spacer for spacing the receptacle apart from the inner surface of the funnel by a predetermined distance, and a support for supporting the receptacle and spacer. An upper end of the support is attached to the receptacle.

The support is made of an elastic material and formed with a curvature corresponding to the interior of the funnel. The bottom end of the support is fixed on an electron gun.

It is to be understood that both the foregoing general description and the following detailed description are exemplary and explanatory and are not intended to be limiting of the invention.

BRIEF DESCRIPTION OF THE DRAWINGS

The accompanying drawings, which are included to provide a further understanding of the invention and are incorporated in and constitute a part of this specification, illustrate a particular embodiment of the invention and, together with the description, serve to explain the principles of the invention. In the drawings.

In the following detailed description, only the preferred embodiment of the invention has been shown and described, simply by way of illustration of the best mode contemplated by the inventor(s) of carrying out the invention. As will be realized, the invention is capable of modification in various other respects, all without departing from the invention. Accordingly, the drawings and description are to be regarded as illustrative in nature, and not as restrictive.

DETAILED DESCRIPTION OF THE INVENTION

Reference will now be made in detail to the preferred embodiments of the present invention, examples of which are illustrated in the accompanying drawings.

A getter flashing method for a CRT according to a first preferred embodiment of the present invention will be now described with reference to FIGS. 1 and 2.

Figure 1:
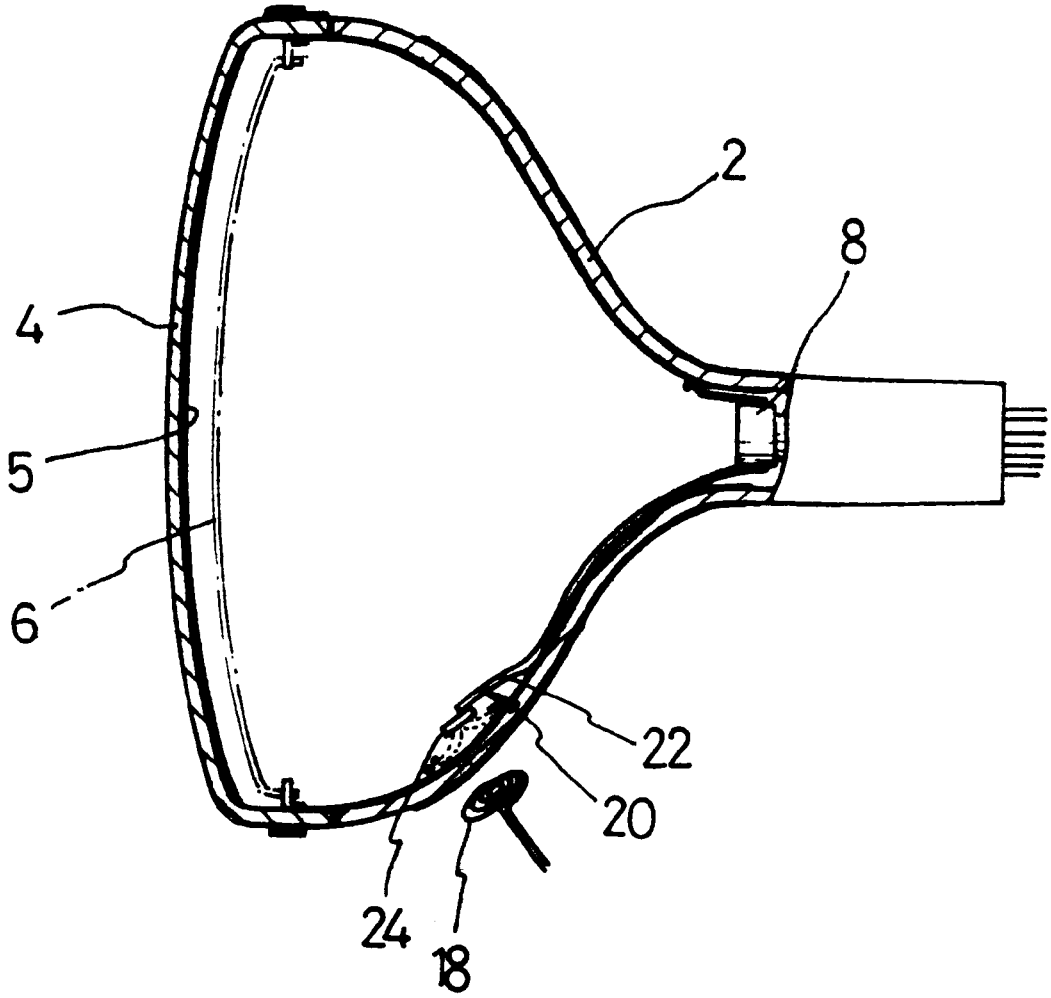
FIG. 1 is a cross section view of a CRT illustrating a getter flashing method according to a first preferred embodiment of the present invention.
Figure 2:
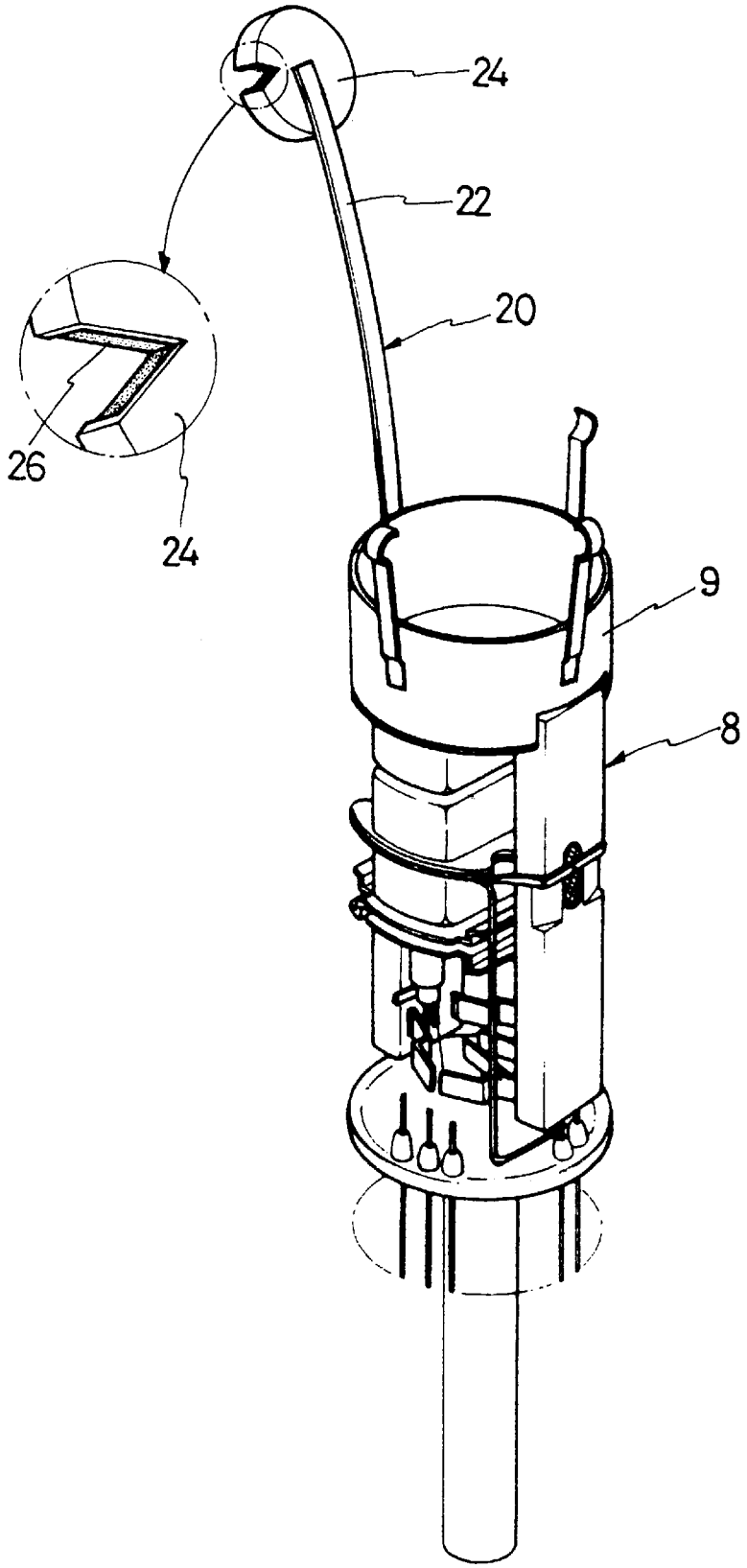
FIG. 2 is a perspective view of a getter according to the first preferred embodiment.

As shown in FIGS. 1 and 2, the getter 20 includes a cup-shaped receptacle 24 for receiving an active metal 26 such as barium and magnesium, and a band-shaped support 22 for supporting the receptacle 24. An upper end of the support 22 is spot-welded to the receptacle 24 such that an opening portion of the receptacle 24 faces a neighboring portion of a funnel 2. In contrast, a bottom end of the support 22 is fixed to a shield cup 9 of an electron gun 8.

Meanwhile, the getter flashing operation is performed such that the active metal 26 is vaporized and diffused toward the portion of the funnel 2 adjacent to the getter 20. For that purpose, the opening portion of the receptacle 24 containing the active metal is directed toward the neighboring portion of the funnel 2.

In order to vaporize the active metal 26, a high-frequency induction heating coil 18 is installed on the outside of a funnel 2 adjacent to the getter 20. The high-frequency induction heating coil 18 applies a high-frequency induced voltage onto the getter 20 for a predetermined time. Then, the active metal 26 is abruptly heated and vaporized to be thereby diffused toward the neighboring funnel portion. When the diffused active metal condenses, it absorbs residual gases such as hydrogen, carbon dioxide and oxygen in the funnel 2 to remove them.

A getter for a CRT according to a second preferred embodiment of the present invention will be now described with reference to FIGS. 3 and 4.

Figure 3:
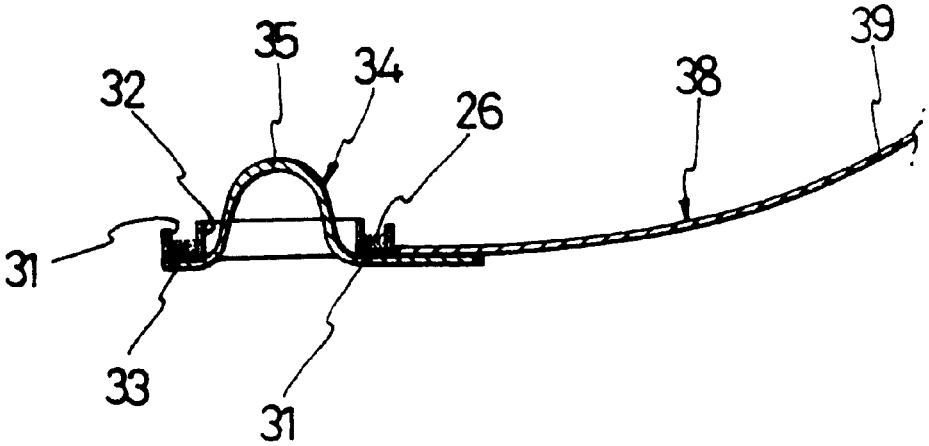
FIG. 3 is a cross sectional view of a getter according to a second preferred embodiment of the present invention.
Figure 4:
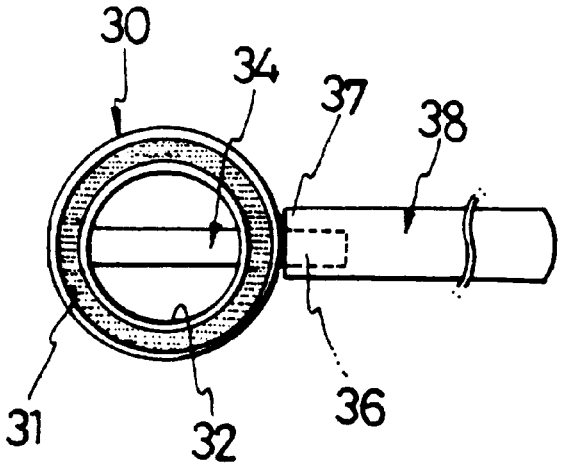
FIG. 4 is a plan view of the getter according to the second preferred embodiment.
Figure 5:
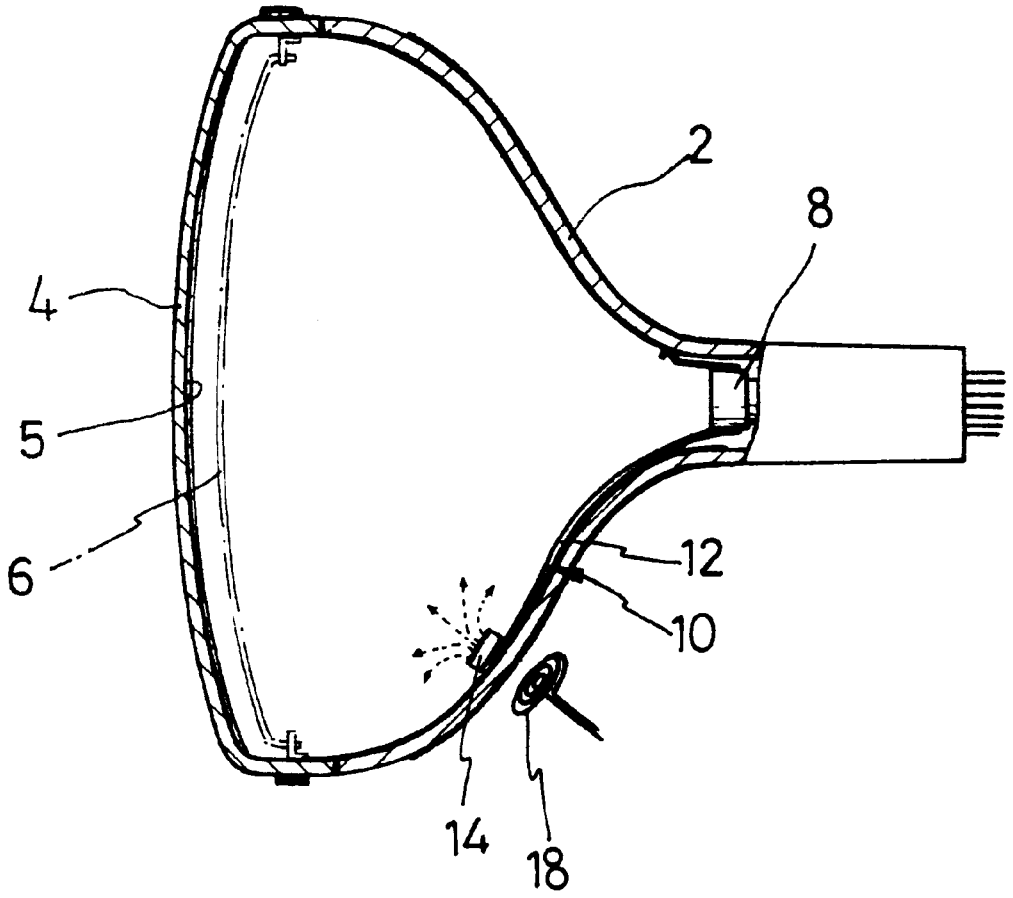
FIG. 5 Prior Art
FIG. 5 is a cross sectional view of a CRT illustrating a conventional getter flashing method.

As shown in FIGS. 3 and 4, the getter includes a receptacle 30 for receiving an active metal 26, a spacer 34 for spacing the receptacle 30 apart from the inner surface of a funnel (not shown), and a band-shaped support 38 for supporting the receptacle 30 and spacer 34.

The support 38 is made of an elastic material and formed with a curvature corresponding to the inner surface of the funnel.

A hole 32 is provided on the center portion of the receptacle 30 to pass the spacer 34 while a groove 31 is formed on the periphery of the receptacle 30 to load the active metal 26 therein.

One end of the spacer 34 is attached to a closed portion 33 of the groove 31 while the other end of the spacer 34 is lengthened over the receptacle 30 and attached to an upper end 37 of the support 38. A bottom end 39 of the support 38 is fixed to a shield cup of an electron gun (not shown).

The spacer 34 passes through the hole 32 and forms a protruding portion 35 on the opening side of the groove 31. The protruding portion 35 is spaced apart from the groove 31 by a predetermined distance.

The protruding portion 35 makes in contact with the inner surface of the funnel. The protruding portion 35 is preferably formed with a curved shape so that it does not do harm to the funnel.

In addition, the protruding portion 35 enables the receptacle 30 to be always spaced apart from the inner surface of the funnel.

When the electron gun and funnel are assembled, the spacer 34 and support 38 are connected to each other such that the opening portion of the receptacle 30 faces the inner surface of the funnel adjacent thereto. That is, the protruding portion 35 of the spacer 34 formed on the opening side of the receptacle 30 is protruded in the curving direction of the support 38.

In the aforementioned getter flashing method, the getter flashing operation can be uniformly performed owing to the definite distance between the receptacle containing the active metal and the inner surface of the funnel.

Furthermore, the active metal is diffused toward the neighboring funnel portion so that it is not deposited on the shadow mask or on the phosphor layer coated on the panel screen, thereby preventing deterioration in brightness.

Moreover, the rainbow-shaped color bar occurring in the mini CRTs can be also prevented by applying the inventive getter flashing method.

It will be apparent to those skilled in the art that various modifications and variations can be made in the getter flashing method for the CRT and the getter for conducting the same of the present invention without departing from the spirit or scope of the invention. Thus, it is intended that the present invention cover modifications and variations of this invention provided they come within the scope of the appended claims and their equivalents.

What is claimed is:

1. A getter for a cathode ray tube with a funnel, the getter comprising:

a receptacle for receiving an active material;

a spacer for spacing the receptacle apart from an interior of the funnel by a predetermined distance; and a support for supporting the receptacle and the spacer, wherein the receptacle comprises a hole for passing the spacer and a groove for receiving the active material therein.

2. The getter of claim 1, wherein the spacer has a protruding portion passing through the hole and extending beyond the groove by a predetermined height.

3. The getter of claim 2 wherein the protruding portion protrudes in a direction from a bottom surface of the groove toward an opening of the groove.

* * * * *